United States Patent [19]

Mankowski

[11] Patent Number: 4,903,445

[45] Date of Patent: Feb. 27, 1990

[54] ROOF RIDGE VENTILATORS

[76] Inventor: John P. Mankowski, 70 W. Boston Blvd., Detroit, Mich. 48202

[21] Appl. No.: 294,400

[22] Filed: Jan. 9, 1989

[51] Int. Cl.[4] ..... F24F 7/02; E04D 1/30

[52] U.S. Cl. ..... 52/199; 52/57; 98/42.21

[58] Field of Search ..... 52/57, 199, 198; 98/42.2, 42.21, 42.22

[56] References Cited

U.S. PATENT DOCUMENTS

| | | | |
|---|---|---|---|
| 2,388,759 | 11/1945 | Moore | 98/42.21 |
| 3,481,263 | 12/1969 | Belden | 52/57 |
| 4,280,399 | 7/1981 | Cumming | 98/42.21 |
| 4,554,862 | 11/1985 | Wolfert | 98/42.21 |
| 4,643,080 | 2/1987 | Trostle et al. | 98/42.21 |
| 4,817,506 | 4/1989 | Cashman | 52/199 |

*Primary Examiner*—Michael Safavi
*Attorney, Agent, or Firm*—Charles E. Baxley

[57] ABSTRACT

A roof ridge ventilator (10) comprises a one-piece cover member (12) including a pair of flaps (14) and a hinge (16) unitary with the flaps to permit pivotal movement therebetween in order to allow use of the ventilator on roof ridges of different angles and pitches, the cover member being designed to be placed under the standard cap shingle such that the shingle extends over the cover member and down the top edges of longitudinally spaced outer support walls. A pair of vents (22) are located below the pair of cover member flaps (14), and each vent has openings (26) to permit air circulation through the roof ridge. Each vent (22) also has an upwardly projecting outer wall angled toward the cover member, and including weepage openings at the bottom of the outer wall spaced between the outer support walls to permit collected liquids to drain therethrough. The angle of the outer walls is designed to deflect air flow over the roof ridge ventilator and across the top of the cap shingle secured to the upper surface of the cover member, thereby substantially preventing foreign particle entry through the roof ridge ventilator into the building. The ventilator easily accomplishes building code requirements for air flow while providing an attractive, nearly undetectable roof ridge ventilator.

16 Claims, 3 Drawing Sheets

ROOF RIDGE VENTILATORS

TECHNICAL FIELD

This invention relates to a roof ridge ventilator.

BACKGROUND OF THE INVENTION

Roof ridge ventilators permit circulation of hot air through the roof of a building to decrease the temperature within the building and to allow for air circulation under the roof, especially desirable for the removal of moisture build-up to prevent rotting of wooden members. Conventionally, roof ventilators have been unsightly, and have further served as nesting places for birds, insects and the like.

Some of the problems with previous roof ridge ventilators have included a projecting height which is too great, multi-piece constructions which are difficult to install, roof ventilators which are unable to adapt to various roof pitches, thereby requiring a multitude of products for different building types and roof ridge ventilators which are generally unsightly.

Furthermore, it has been found that roof ridge ventilators must be of a sturdy construction to withstand pressures of shipping and handling, and should not be able to be easily damaged. Furthermore, other considerations for shipping and handling include the ability of a design to provide a compact ventilator, one that can be shipped in a flat position, and one that can be stored in inclement weather conditions. Further considerations in the design of a roof ridge ventilator include aesthetics, propensity of air volume circulation, resistance to deterioration, ability to withstand exposure to high winds and other inclement weather conditions, and its ability to prevent dirt, rain and insects into the attic space being ventilated.

An object of the present invention is to provide an improved roof ridge ventilator having particular utility in the construction of residential and commercial buildings.

Another object of the present invention is to provide an improved roof ridge ventilator which will exhibit superior performance regardless of the orientation of the building.

Yet another object of the present invention is to deflect air flow to limit entry of foreign particles through the roof ridge into the ventilated space below. The accumulation of seedlings, leaves or the like which could block the circulating air flow through the vent are blown out of the exposed region by air leaving the ventilated space. The vent of the present invention greatly increases the net-free area of the vent when compared to prior art roof ridge ventilators. Dust and dirt which may temporarily be collected in the exposed portion of the ventilator is washed down the remaining roof through the weepage openings.

It is yet still another object of the present invention to provide a roof ridge ventilator which can easily be manufactured and easily installed.

The objects, features, and advantages of the present invention are readily apparent from the following detailed description of the best mode for carrying out the invention when taken in connection with the accompanying drawings.

Previous inventions have included roof ridge ventilators which are placed on top of the shingles, such as U.S. Pat. No. 3,481,263 issued to M. C. Belden on Dec. 2, 1966 and U.S. Pat. No. 3,303,773 issued to L. L. Smith, et al., on Feb. 14, 1967. More recent inventions include roof ridge ventilators which are placed underneath cap shingles, for example, U.S. Pat. No. 3,236,170 issued to Meyer, et al., U.S. Pat. No. 4,280,399 issued to Joseph M. Cunning and U.S. Pat. No. 4,676,147 issued to the present inventor, John P. Mankowski.

DISCLOSURE OF INVENTION

In accordance with the present invention, an improved roof ridge ventilator is provided having increased air flow due to proper air deflection over the cap shingle secured to the top of the ventilator. Rain, insects and dirt particles are prevented from entering the ventilated space while retaining compact size, low cost, ease of manufacture, ease of installation, sturdiness, and longevity. Essentially, the present roof ridge ventilator is adapted to extend longitudinally on a roof ridge covering the peak of the roof ridge. The ventilator is placed into position by merely laying the ventilator over the peak of the roof, and nailing through the ventilator into the materials below.

Specifically, the present invention includes a one-piece cover member of an elongated shape which includes a pair of flaps, each flap having an upper surface over which the cap shingles are secured and downwardly facing lower surface which has a pair of vents secured thereto. Each vent has a longitudinally extending inner wall with an upward slant and openings to permit air circulation through the roof ridge. In the preferred embodiment, the openings are of a louvered design. Each vent also has longitudinally spaced-apart support walls which run perpendicular to the peak of the roof that extend substantially vertically to limit the entry of dirt, insects and other foreign particles into the ventilated space. The support walls extend outwardly from under the cover member and extend beyond the cover member to leave portions of the support walls uncovered by the cap shingle and exposed to the outer elements. The exposed portions of the support walls have top edges which slope downward underneath the cap shingles and it is intended that the exposed portions of the support walls will be partially covered by the outermost edges of the cap shingle after installation. In addition, the outer walls have weepage openings to permit collected liquids to drain therethrough.

In order to deflect air over the cap shingle after it has been installed, each vent of the present invention has a longitudinally extending, upwardly projecting outer wall which connects the longitudinally spaced support walls and acts as a deflection means. The outer wall is angled toward the center of the ventilator and is made of a solid piece of material, with the exception of weepage openings at the bottom of the outer wall. The weepage openings are spaced between the outer support walls to permit collected liquids to drain therethrough.

BEST MODE FOR CARRYING OUT THE INVENTION

Figure 1:
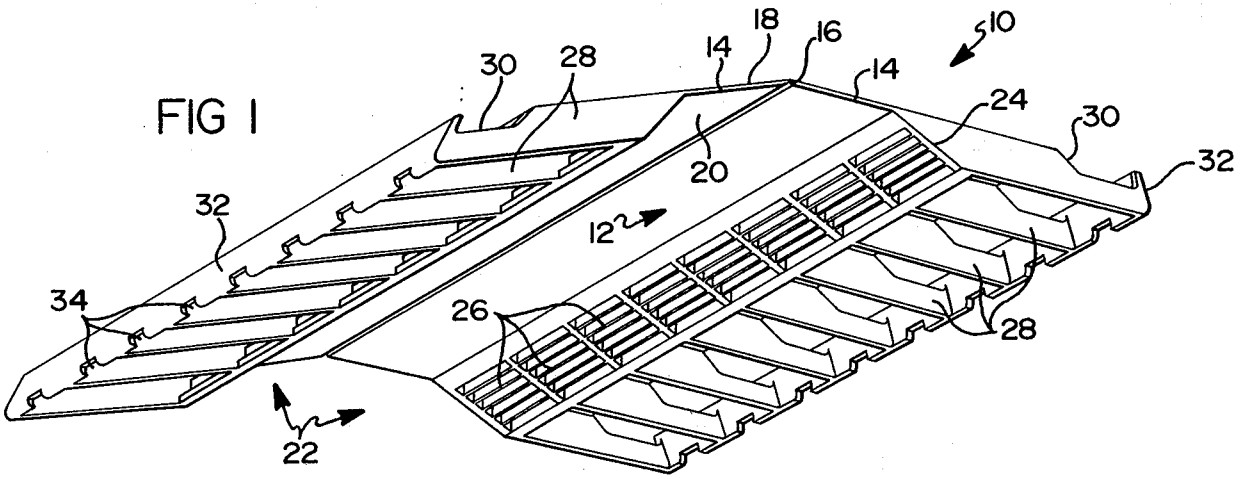
FIG. 1 is a perspective view of a roof ridge ventilator constructed in accordance with the present invention.

With reference to FIG. 1 of the drawings, a roof ridge ventilator constructed in accordance with the present invention is generally indicated by reference number 10, having particular utility in the construction of residential and commercial buildings. Roof ridge ventilator 10 includes a one-piece cover member 12 of an elongated shape including a pair of flaps 14 and a hinge 16 unitary with the flaps and furthermore includes a longitudinal groove therebetween. The construction of the cover member 12 permits use of the ventilator 10 on roof ridges of varying pitches and angles. Cover member 12 has an upper surface 18 over which cap shingles are secured. The securement is normally provided by nailing through both the cap shingles and the ventilator 10 and is hereinafter more fully described.

Roof ridge ventilator 10 also includes a pair of vents 22 respectively located beneath the pair of cover member flaps 14. As hereinafter more fully described, each vent 22 has a slanted inner wall 24 which extends inwardly and upwardly. Inner wall 24 has a plurality of vent openings 26 as illustrated in FIGS. 1 through 4 to permit air circulation through the ventilator. Preferably, the openings 26 have a louver configuration, and include at least two louvers extending upwardly. The louvers are approximately from 0.100 to 1.0 inches wide, and from 0.5 to 5 inches long. Each vent also has support walls 28 which have top edges 30 for supporting the vent and the cap shingle secured thereto. Vents 22 are secured to lower surface 20 of flaps 14, preferably by attaching to the support walls 28. Each vent has a longitudinally extending, upwardly projecting outer wall 32 connecting the longitudinally spaced support walls 28, and angling toward the center of the cover member 12. Angled outer walls 32 have weepage openings 34 at the bottom which are spaced between the support walls to permit collective liquids to drain therethrough. The ventilator 10 may be made of plastic such as polypropylene, nylon, thermoplastic, epoxy resins, polyurethane or any other plastic inherent to various manufacturing methods. Both the cover member 12 and the vents 22 of the ventilator are preferably made from these materials, although it is possible to utilize a suitable metal such as aluminum or sheet steel. The most preferred plastic is polypropylene because it emits bug repelling odors so that insects and bugs are discouraged from nesting or entering the roof through the ventilator.

Figure 4:
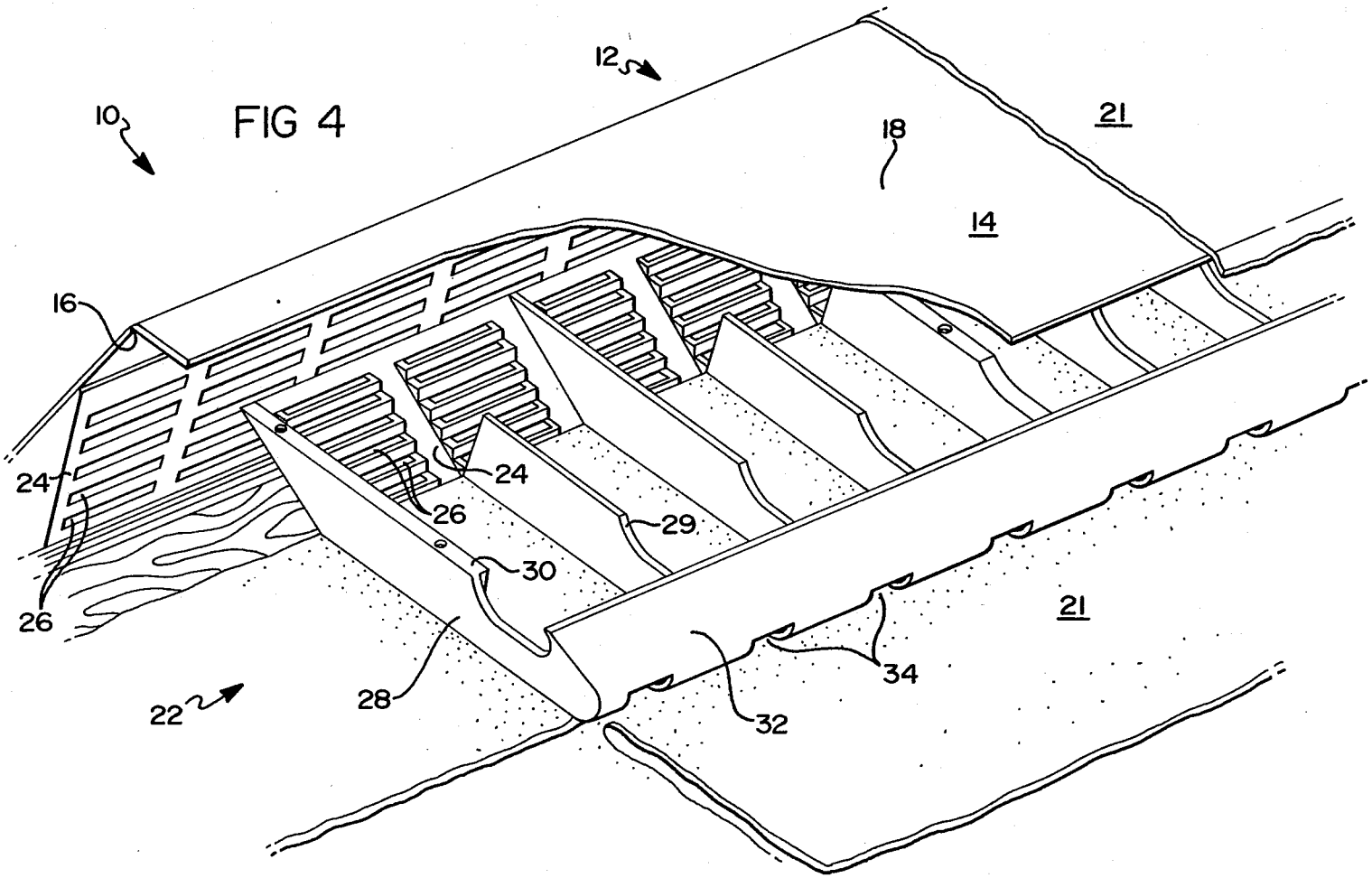
FIG. 4 is a perspective view of a roof ridge ventilator constructed in accordance with the present invention illustrating positioning of the ventilator when installed.

Cover member 12 is designed to provide a ventilator with a lateral width that is substantially the same as the width of a standard cap shingle which is to be placed over the ventilator as illustrated in FIG. 4. Upon installation, the cap shingle should conform to the shape of the ventilator and thereby have the same pitch as the pitch of the roof, providing an aesthetically appealing appearance.

Figure 2:
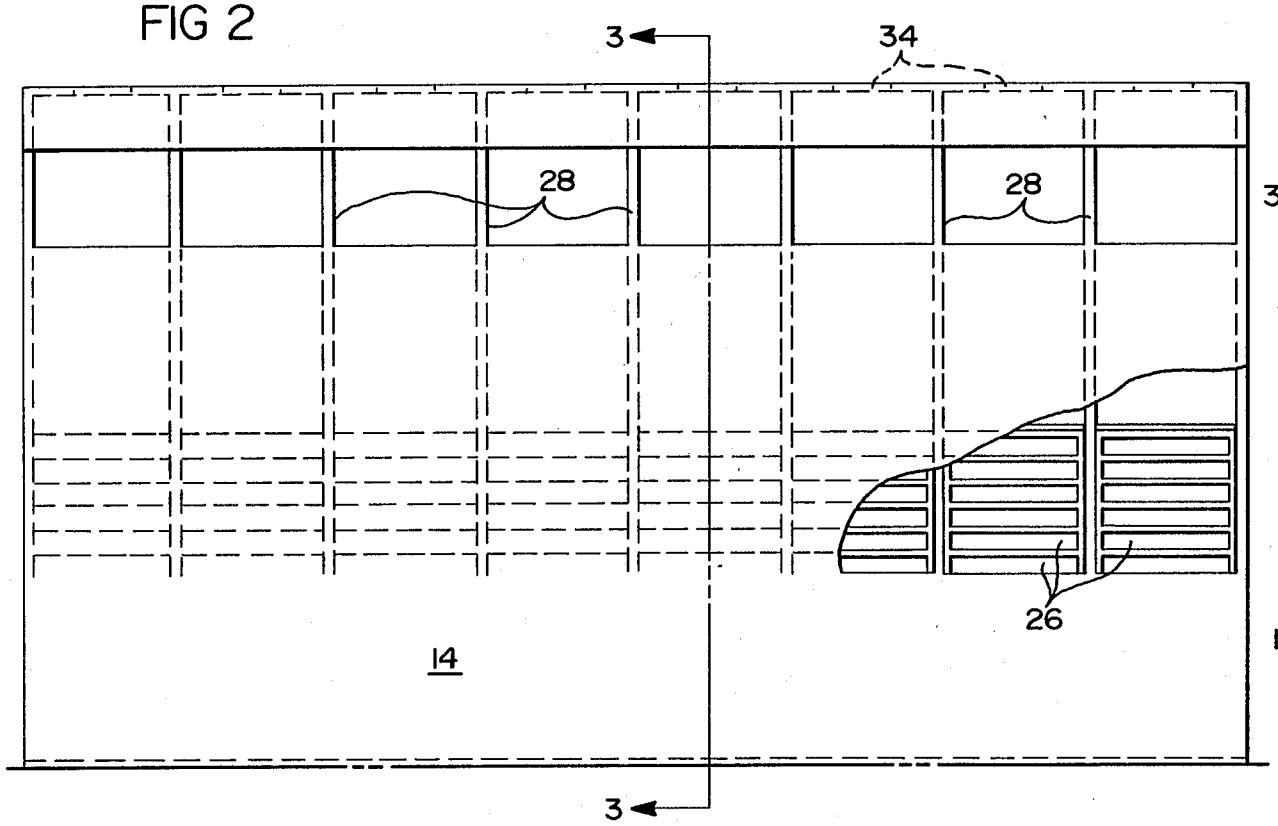
FIG. 2 is a top view through a roof ridge ventilator constructed in accordance with the present invention.

Turning now to FIG. 2, a top plan view of the roof ridge ventilator of the present invention is illustrated showing the relative location of louver openings 26, support walls 28 and weepage openings 34. With combined reference to FIG. 2 and FIG. 3, the special construction and angle of the angled outer wall 32 is illustrated. Flap 14, having an upper surface 18 and a lower surface 20, is shown having vent 22 attached to the lower surface of the flap. As illustrated, inner wall 24 includes louver openings 26. The top surface 30 of support wall 28 includes a descending portion 29 adapted to receive and be partially covered by the outermost edges of the cap shingle secured to the upper surface of the cover member, as better seen in FIG. 4. Support walls 28 are shown approximately ½ inch to 3 inches apart.

Figure 3:
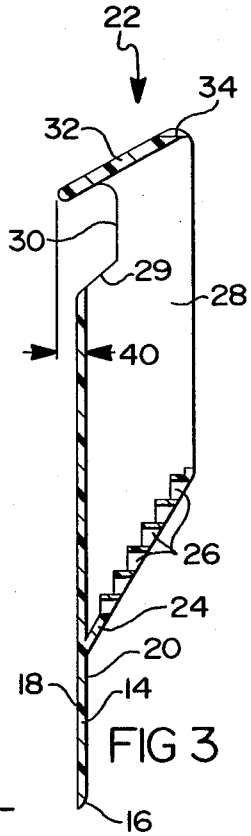
FIG. 3 is a partial sectional view taken along the direction of lines 3—3 in FIG. 2 to illustrate vent openings of the ventilator.

As shown in FIG. 3, the angled outer wall 32 extends upwardly and inwardly at an angle of approximately ten to seventy-five degrees with respect to the upper surface plane of the cover member flap. The angled outer wall extends upwardly from the top surface 18 of flap 14 by a distance denoted by numeral 40. Distance 40 may range from 0.001 to about 2 inches depending upon the application. Preferably, distance 40 is about 0.125 inches or the height of a standard shingle used in residential applications. This additional upward extension of the angled outer wall 32 is useful in deflecting the air flow over the roof ridge ventilator and across the top of the cap shingle. By deflection over the angled outer wall, the air is thrust onto the shingle body which has been attached to the vent. The advantage realized is the air is directed neither above nor below the shingle, but rather, across it thereby substantially preventing foreign particle entry through the roof ridge ventilator into the building.

With reference now to FIG. 4, the roof ridge ventilator described hereinabove is shown in a perspective view placed underneath shingles 21 and illustrates the placements of the upper cap shingle 21 as installed over the roof ridge ventilator 10. Shingle 21 extends beyond the outermost dimension of flap 14 slightly and rests on the downwardly sloped descending portion 29 of top edge 30. Flaps 14 of roof ridge ventilator 10 are formed such that a cap shingle 21 will extend laterally across the roof ridge ventilator and hang slightly into the open exposed area as shown in FIG. 4. The roof ridge ventilator 10 preferably has a length of about five feet, but may be any convenient length.

As illustrated in FIG. 4, each vent 22 of the ventilator includes a longitudinally extending inner wall 24 in which the vent openings 26 are provided. The louvered construction may be formed by slicing the sheet material of inner wall 24 and pressing the material into a louvered design. Alternatively, the louver openings may be formed during the injection molding process. Inner wall 24 acts as an interior baffle structure to prevent foreign particles and debris from entering the roof of the building, while allowing a substantially increased net free flow area for exhausting air through the roof. Suitable connections for securing the flaps 14 to support walls 28 may include many conventional means and methods, including rivets, heat deformation, and adhesive securing methods. When ventilator 10 is made from plastic or polyethylene, adhesives or rivets are preferable. The louver openings 26 have openings from about 0.1 to about 1.0 inches wide, and from about 0.5 to about 5.0 inches long. Preferably, there are at least 50 louvers extending upwardly in each roof ridge ventilator. Weepage openings 34 include at least one opening between each pair of longitudinally spaced support walls. The weepage openings are intended to allow liquids which collect in the inner recess of the ventilator to drain therethrough. Weepage openings 34 are preferably from about 0.25 to about 1.0 inches in length.

Figure 5:
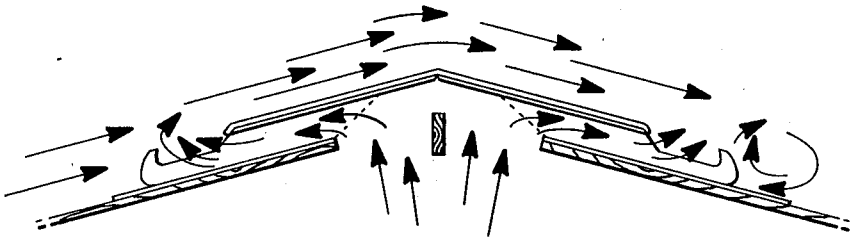
FIG. 5 is a view taken in section through roof ridge when installed, illustrating air deflection over the roof.

Turning now to FIG. 5, a roof ridge ventilator constructed in accordance with the present invention is shown installed on a conventional roof. As can be seen from the drawing, the air rising to the top of the roof is exhausted by the roof ridge ventilator through the recesses between support walls 28. Such a construction may provide at least about 3 cubic feet of circulating air flow per minute per 100 cubic feet of attic space when the ventilator 10 is utilized with a conventional roof. Furthermore, the size of the openings 26 is nevertheless sufficiently small to prevent most foreign particles from passing therethrough or clogging the vents. The angled outer walls 32 act to deflect air flow up over the cap shingle 21 so that air flow across the roof is not impeded. The design of the present invention is intended to aid ventilation through the ventilator without regard to the orientation of the building.

While the best mode for constructing the invention has been herein described in detail, those familiar with the art to which this invention relates will recognize various alternative ways of carrying out the invention as defined by the following claims.

What is claimed is:

1. A roof ridge ventilator to be installed under a cap shingle, comprising:

a one-piece cover member of an elongated shape including a pair of flaps, each flap having an upper surface over which cap shingles are secured and also having downwardly facing lower surfaces;

a pair of vents respectively secured to the lower surface of the cover member flaps;

a plurality of longitudinally spaced support walls in each vent that extend substantially vertically to limit entry of foreign particles through the roof ridge;

said support walls extending outwardly from under the cover member and extending beyond the cover member, thereby leaving portions of the support walls uncovered by the cap shingle and exposed to the outer elements;

said exposed portions of the support walls including top edges which descend downwardly from the plane of the upper surface, and said top edges being adapted to receive and be partially covered by the outermost edges of the cap shingle secured to the upper surface of the cover member;

each vent having inner walls with openings to permit air circulation;

each vent having a longitudinally extending, upwardly projecting outer wall connecting said longitudinally spaced support walls; and weepage openings in the outer wall at the bottom of the outer wall spaced intermediate said outer support walls to permit collected liquids to drain therethrough.

2. A ventilator as in claim 1, wherein said ventilator is made of plastic.

3. A ventilator as in claim 1, wherein said ventilator is made of polypropylene.

4. A ventilator as in claim 1, further comprising a unitary hinge located centrally between the outer edges of the cover member flaps.

5. A ventilator as in claim 1, wherein said ventilator further includes a longitudinal groove between the flaps to permit pivotal movement of the flaps in order to allow use of the ventilator on roof ridges of different angles and pitches.

6. A ventilator as in claim 1, wherein said ventilator is formed to a length of about 5 feet.

7. A ventilator as in claim 1, wherein the width of said cover member between the outer edges is approximately the width of a standard cap shingle.

8. A ventilator as in claim 1, wherein said longitudinally extending outer wall projects inwardly and upwardly at an angle of approximately ten to seventy-five degrees with respect to the upper surface plane of the cover member flap.

9. A ventilator as in claim 1, wherein said openings to permit air circulation include louvers formed in the inner walls.

10. A ventilator as in claim 9, wherein said louver openings include at least 50 louvers.

11. A ventilator as in claim 9, wherein said louver openings are from about 0.100 to about 1.0 inches wide.

12. A ventilator as in claim 9, wherein said louver openings are from about 0.5 to about 5.0 inches long.

13. A ventilator as in claim 1, wherein said weepage openings include at least one weepage opening between each pair of longitudinally spaced outer support walls.

14. A louvered roof ridge ventilator, comprising:

a one-piece plastic cover member of an elongated shape including a pair of flaps and a hinge unitary with the flaps and including a longitudinal groove therebetween to permit pivotal movement of the flaps in order to allow use of the ventilator on roof ridges of different angles and pitches;

each flap having an upper surface over which cap shingles are secured and also having a downwardly facing lower surface and having longitudinal outer edges spaced from each other on opposite sides of the hinge;

a pair of outwardly and downwardly projecting vents respectively secured to the lower surfaces of the cover member flaps;

each vent having a longitudinally extending inner wall slanting upwardly and inwardly including louver openings to permit air circulation through the roof ridge;

a plurality of longitudinally spaced outer support walls in each vent that extend substantially vertically to limit entry of foreign particles through the roof ridge;

said support walls extending outwardly from under the cover member and extending beyond the cover member thereby leaving portions of the support walls uncovered by the cap shingle and exposed to the outer elements;

said exposed portions of the support walls including top edges which descend downwardly from the plane of the upper surface, said top edges being adapted to receive and be partially covered by the outermost edges of the cap shingle secured to the upper surface of the cover member, leaving the remaining portion of the outer support walls exposed to the outer elements;

each vent having a longitudinally extending, upwardly projecting outer wall connecting said longitudinally spaced support walls; and weepage openings in said outer wall at the bottom of the outer wall spaced between the support walls to permit collected liquids to drain therethrough.

15. A ventilator as in claim 14, wherein said upwardly projecting outer wall is angled inwardly and upwardly toward the cover member at from about fifteen to seventy-five degrees, thereby deflecting air flow across the upper surface of the cap shingle.

16. A ventilator as in claim 14, wherein said ventilator is made of a plastic selected from the group consisting of polymers, polypropylene, nylon, thermoplastic, epoxy resins and polyurethane.

* * * * *